US006686137B2

(12) United States Patent
Takahashi et al.

(10) Patent No.: US 6,686,137 B2
(45) Date of Patent: Feb. 3, 2004

(54) SILVER HALIDE PHOTOGRAPHIC LIGHT-SENSITIVE MATERIAL

(75) Inventors: Osamu Takahashi, Minami-ashigara (JP); Yoshiharu Yabuki, Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 10/023,830

(22) Filed: Dec. 21, 2001

(65) Prior Publication Data

US 2003/0031962 A1 Feb. 13, 2003

(30) Foreign Application Priority Data

Dec. 27, 2000 (JP) ..... 2000-398298

(51) Int. Cl.[7] ..... G03C 1/46

(52) U.S. Cl. ..... 430/505; 430/517; 430/522; 430/559

(58) Field of Search ..... 430/517, 522, 430/559, 505

(56) References Cited

U.S. PATENT DOCUMENTS 5,288,600 A * 2/1994 Yamanouchi et al. ..... 430/522
6,027,866 A * 2/2000 Ohzeki ..... 430/521
6,190,821 B1 * 2/2001 Vandenabeele ..... 430/559

* cited by examiner

*Primary Examiner*—Geraldine Letscher
(74) *Attorney, Agent, or Firm*—Sughrue Mion, PLLC

(57) ABSTRACT

A silver halide photographic light-sensitive material, which has, on a reflective support, at least one silver halide emulsion layer containing a cyan dye-forming coupler, at least one silver halide emulsion layer containing a magenta dye-forming coupler, at least one silver halide emulsion layer containing a yellow dye-forming coupler, and at least one light-insensitive layer, wherein oil droplets containing a dispersion of at least one blue pigment are dispersed in at least one layer of the layers.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more particularly to a silver halide photographic light-sensitive material having an improved white background.

BACKGROUND OF THE INVENTION

Generally, a color print is obtained by exposing and processing a color paper, having a resin coat paper support and thereon a blue-light-sensitive silver halide emulsion, a green-light-sensitive silver halide emulsion, and a red-light-sensitive silver halide emulsion, which are combined with yellow, magenta, and cyan couplers, respectively. During processing steps, yellow stain occurs owing to couplers, ultraviolet-absorbing agents (sometimes hereinafter referred to as UV absorbers), and other additives in the photographic element, such as the light-sensitive material, resulting in yellow coloring of the white background.

To make the white background look as white as possible, a pigment is generally incorporated in the above-mentioned resin coat paper, to compete with yellow stain in tint. In the case of a paper support that is used for various products, each having different stain characteristics, however, there is the problem that the tint correction of a support suitable for one particular product is not suitable for other products. Further, these pigments for tint correction, which are generally incorporated together with a white pigment, such as titanium oxide, in a resin layer, are inevitably used in a large amount, owing to a hiding effect of the white pigment. To solve the problem, a method of incorporating an emulsion dispersion, of an oil-soluble dye, in a hydrophilic colloid layer coated on a support, is proposed. In this case, however, there is a problem that these dyes, which are generally inferior in fastness as compared to pigments, are discolored by heat or light, resulting in a change in color balance of the white background. Further, there is a method in which a pigment is dispersed by means of a ball mill and the like, and the resulting dispersion is incorporated in a hydrophilic colloid layer. However, this method requires much time and labor. Accordingly, there is need for a method that enables tint correction of the white background with steadiness and convenience.

SUMMARY OF THE INVENTION

The present invention is a silver halide photographic light-sensitive material, which has, on a reflective support, at least one silver halide emulsion layer containing a cyan dye-forming coupler, at least one silver halide emulsion layer containing a magenta dye-forming coupler, at least one silver halide emulsion layer containing a yellow dye-forming coupler, and at least one light-insensitive layer, wherein oil droplets containing a dispersion of at least one blue pigment are dispersed in at least one layer of said layers.

Other and further features and advantages of the invention will appear more fully from the following description.

DETAILED DESCRIPTION OF THE INVENTION

According to the present invention, there is provided the following means:

(1) A silver halide photographic light-sensitive material, having, on a reflective support, at least one silver halide emulsion layer containing a cyan dye-forming coupler, at least one silver halide emulsion layer containing a magenta dye-forming coupler, at least one silver halide emulsion layer containing a yellow dye-forming coupler, and at least one light-insensitive layer, wherein oil droplets containing a dispersion of at least one blue pigment are dispersed in at least one layer of said layers.

(2) The silver halide photographic light-sensitive material according to the item (1), wherein the blue pigment is at least one pigment selected from a group consisting of indanthrone pigments, indigo pigments, and triarylcarbonium pigments.

(3) The silver halide photographic light-sensitive material according to the item (2), wherein the blue pigment is an indanthrone pigment, and wherein at least one red pigment and/or at least one violet pigment, each of which is selected from a group consisting of azo pigments, quinacridone pigments, dioxazine pigments, and diketopyrrolopyrrole pigments, is dispersed in at least one layer of the layers.

(4) The silver halide photographic light-sensitive material according to the item (1), (2), or (3), wherein a resultant hue of an unexposed portion after development processing, which is defined by L*, a*, and b* stipulated in CIE LAB, satisfies the following relationship:

$L^*>88$, $-2<a^*<2$, and $-2<b^*<2$.

The term "oil droplets" herein used refers to microscopic oil droplets in an oil-in-water (O/W)-type dispersion system.

The present invention is explained in detail below.

In the silver halide photographic light-sensitive material of the present invention, at least one blue pigment is dispersed in oil droplets which are dispersed in at least one layer of light-sensitive silver halide emulsion layers and light-insensitive layers, each of which are coated on a reflective support. In other words, at least one hydrophilic colloid layer coated on a reflective support is a layer containing an insoluble pigment. In the present invention, the blue pigment-containing layer may be a light-sensitive layer containing a silver halide emulsion, or it may be any of light-insensitive layers, such as interlayers positioned between silver halide emulsion layers, and ultraviolet-absorbing layers positioned above (as overlayers of) the silver halide emulsion layers. In order to regulate the characteristic curve, a coating flow rate of the silver halide emulsion layer is generally changed. Therefore, it is often preferred to incorporate a pigment in a light-insensitive layer so that tinting is kept constant.

Usually yellow stain is conquered by blue-tinting. Such tinting is generally performed by adding a pigment in an amount sufficient to compete with yellow stain so as to form a neutral color which looks like white by a human eye. Further, it is possible to correct the yellow stain over the wide range, by using two or more kinds of pigment with different amounts to be used from each other. Generally a blue pigment which changes a resulting hue to the cyan side, and a red or violet pigment which changes a resulting hue to the magenta side, are used in combination. Such combination use enables to control the tint over the wide range.

The pigment for use in the present invention is not particularly limited, so long as it is water-insoluble. Particularly preferably, the pigment has a strong affinity to an organic solvent and moreover it is easily dispersed in the organic solvent.

Generally, in order to effectively tint, the particle size of the pigment is preferably 0.01 μm to 5 μm, more preferably 0.01 μm to 3 μm.

In the present invention, the pigment is most preferably introduced as follows:

Similarly to the method in which a photographically useful substance such as an ordinary dye-forming coupler (also referred to as a coupler herein) is emulsified and dispersed, and the resulting dispersion is included in a light-sensitive material, the pigment for use in the present invention is added to a high boiling point organic solvent to form an uniform spontaneous dispersion liquid composed of fine-particles of the pigment. The resulting liquid is emulsified and dispersed together with a dispersing agent of a surface active agent, in a hydrophilic colloid (preferably an aqueous gelatin solution), by means of a known device such as ultrasonic, colloid mill, homogenizer, Manton-Gaulin, or high speed DISOLVER, so that a dispersion of the pigment can be obtained in the form of fine particles of the pigment.

The high boiling point organic solvent that can be used in the present invention is not particularly limited, and ordinary ones can be used. Examples of the solvent include those described in U.S. Pat. No. 2,322,027 and JP-A-7-152129 ("JP-A" means unexamined published Japanese patent application).

An auxiliary solvent may be used together with the high boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, β-ethoxyethyl acetate, methyl cellosolve acetate, methyl carbitol acetate and cyclohexanone.

The pigment for use in the present invention is most preferably used as an emulsion which is prepared by including the pigment in an organic solvent having dissolved therein a photographically useful compound such as a coupler for use in the light-sensitive material of the present invention, and then subjecting the resulting mixture to co-emulsification.

The present invention is explained in more detail with reference to the following some examples. However, the present invention is not limited to those examples, unless otherwise specified.

In the present invention, any kind of pigment can be used without limitation, so long as the pigment enables to control the color tone as required and also can remain in a light-sensitive material without changing itself at the time of processing. Preferable pigments are explained with reference to specific examples below. The term "blue pigment" herein used refers to a pigment classified as the C.I. Pigment Blue in "Color Index" (The Society of Dyers and Colourists). Similarly, the term "red pigment" and the term "violet pigment" herein used refer to a pigment classified as the C.I. Pigment Red and a pigment classified as the C.I. Pigment Violet, in "Color Index", respectively.

Examples of the blue pigment for use in the present invention include organic pigments, such as azo pigments (e.g., C.I. Pigment Blue 25), phthalocyanine pigments (e.g., C.I. Pigment Blues 15:1, 15:3, 15:6, 16, 75), indanthrone pigments (e.g., C.I. Pigment Blues 60, 64, 21), basic dye lake pigments of triarylcarbonium series (e.g., C.I. Pigment Blues 1, 2, 9, 10, 14, 62), acidic dye lake pigments of triarylcarbonium series (e.g., C.I. Pigment Blues 18, 19, 24:1, 24:x, 56, 61), and indigo pigments (e.g., C.I. Pigment Blues 63, 66). Among these pigments, indanthrone pigments, basic dye lake pigments and acidic dye lake pigments of triarylcarbonium series, and indigo pigments are preferred in view of the resultant hue. Further, indanthrone pigments are most preferred from the viewpoint of fastness.

As the blue pigment, ultramarine and cobalt blue each of which is an inorganic pigment, can also be preferably used in the present invention.

Among indanthrone pigments for use in the present invention, those having high affinity to an organic solvent are particularly preferred. Such pigments can be selected from commercially available products. For example, Blue A3R-KP (trade name) and Blue A3R-K (trade name), each of which are manufactured by Ciba Speciality Chemicals, can be used.

In order to control the hue in the present invention, red and/or violet pigments are preferably used in combination with the blue pigment.

Preferable examples of the red pigment include azo pigment (e.g., C.I. Pigment Reds 2, 3, 5, 12, 23, 48:2, 48:3, 52:1, 53:1, 57:1, 63:2, 112, 144, 146, 150, 151, 166, 175, 176, 184, 187, 220, 221, 245), quinacridone pigments (e.g., C.I. Pigment Reds 122, 192, 202, 206, 207, 209), diketopyrrolopyrrol pigments (e.g., C.I. Pigment Reds 254, 255, 264, 272), perylene pigments (e.g., C.I. Pigment Reds 123, 149, 178, 179, 190, 224), perynone pigments (e.g., C.I. Pigment Red 194), anthraquinone pigments (e.g., C.I. Pigment Red 83:1, 89, 168, 177), benzimidazolone pigments (e.g., C.I. Pigment Reds 171, 175, 176, 185, 202), basic dye lake pigments of triarylcarbonium series (e.g., C.I. Pigment Red 81:1, 169), thioindigo pigments (e.g., C.I. Pigment Reds 88, 181), pyranthrone pigments (e.g., C.I. Pigment Reds 216, 226), pyrazoloquinazolone pigments (e.g., C.I. Pigment Reds 251, 252), and isoindoline pigments (e.g., C.I. Pigment Red 260). Among these pigments, azo pigments, quinacridone pigments, diketopyrrolopyrrol pigments and perylene pigments are more preferred. Azo pigments and diketopyrrolopyrrol pigments are particularly preferred.

Preferable examples of the violet pigment include azo pigments (e.g., C.I. Pigment Violets 13, 25, 44, 50), dioxazine pigments (e.g., C.I. Pigment Violets 23, 37), quinacridone pigments (e.g., C.I. Pigment Violets 19, 42), basic dye lake pigments of triarylcarbonium series (e.g., C.I. Pigment Violets 1, 2, 3, 27, 39), anthraquinone pigments (e.g., C.I. Pigment Violets 5:1, 33), perylene pigments (e.g., C.I. Pigment Violet 29), isoviolanthrone pigments (e.g., C.I. Pigment Violet 31), and benzimidazolone pigments (e.g., C.I. Pigment Violet 32). Among these pigments, azo pigments, dioxazine pigments and quinacridone pigments are more preferred. Dioxazine pigments are particularly preferred.

Among dioxazine pigments for use in the present invention, those having high affinity to an organic solvent are particularly preferred. Such pigments can be selected from commercially available products. For example, Violet B-K (trade name) and Violet B-KP (trade name), each of which are manufactured by Ciba Speciality Chemicals, can be used.

In order to control the hue in the present invention, other pigments (those classified into C.I. Pigment Yellow, C.I. Pigment Orange, C.I. Pigment Brown, C.I. Pigment Green, respectively) may be used in addition to the above-mentioned pigments.

Specific compounds are described in "Color Index" (The Society of Dyers and Colourists), and by W. Herbst and K. Hunger, *Industrial Organic Pigments* (VCH Verlagsgesellschaft mbH (1993)).

As the pigment recited above, one which has not been treated or one which has been surface-treated may be used in the present invention. As the surface treatment, for example, a method of surface-coating with a resin or wax, a method of adhering a surface active agent, a method of binding a reactive material (e.g., a silane coupling agent, an epoxy compound, polyisocyanate) to the surface of pigment, and a method of employing a pigment derivative (synergist) are proposed, as described in the following literatures:

*Kinzoku Sekken no Seishitsu to Oyo* (*Properties and Applications of Metal Soap*) (Saiwai Shobo),

*Insatsu Inku Gijyutsu* (*Printing Ink Technology*) (CMC Shuppan, 1984),

*Saishin Ganryo Oyo Gijyutsu* (*The newest Pigment Applied Technology*) (CMC Shuppan, 1986).

Of these pigments, easily dispersive pigments which are commercially avairable in the form of the pigment whose surface is previously coated with a resin or wax, are called instant pigments (for example, Microlith pigment, manufactured by Ciba Speciality Chemicals). Such an instant pigment is particularly preferred on account that when the pigment is introduced into a light-sensitive material, no dispersion is necessary, but the pigment is able to excellently disperse in a high boiling point organic solvent. In this case, the high boiling point organic solvent having the pigment dispersed therein may be further dispersed in a hydrophilic colloid such as gelatin.

In the present invention, as mentioned above, the pigment may be dispersed in a high boiling point organic solvent, followed by further dispersing of the resulting dispersion into a hydrophilic colloid such as gelatin. Alternatively, the pigment may be directly dispersed in a hydrophilic colloid. At this time, various kinds of dispersants, such as surfactant type-low molecular dispersants and high molecular dispersants, may be used, in accordance with a binder and a pigment to be used together. However, employment of the high molecular-type dispersant is more preferred from the viewpoint of dispersion stability. Examples of the dispersant include those described in JP-A-3-69949 and European Patent No. 549 486.

A particle size after dispersion of the pigment for use in the present invention is preferably in the range of 0.01 $\mu$m to 10 $\mu$m, more preferably in the range of 0.02 $\mu$m to 1 $\mu$m.

In order to disperse a pigment in a binder, known dispersion methods which are applied for the production of ink, toner, and the like, may be used. Examples of the dispersing machine include sand mill, atliter, pearl mill, super mill, ball mill, impeller, disperser, KD mill, colloid mill, dynatron, three-leg roll mill, and pressure kneader. The details are described in *Saishin Ganryo Oyo Gijyutsu* (*The Newest Pigment Applied Technology*) (CMC Shuppan, 1986).

The total amount to be used of the pigments that can be used in the present invention is preferably in the range of 0.1 mg/m$^2$ to 10 mg/m$^2$, more preferably in the range of 0.3 mg/m$^2$ to 5 mg/m$^2$. Further, a blue pigment is preferably used in combination with other pigments having different hue from that of the blue pigment.

When the blue pigment is used in combination with the aforementioned red pigment and/or violet pigment in the present invention, they may be used, by dispersing in the same hydrophilic colloid layer or in different hydrophilic colloid layers. That is, the layer to which the blue pigment is added is not particularly limited.

The silver halide photographic light-sensitive material of the present invention is controlled, by properly selecting the kind and amount of the pigments to be used, so that the resultant hue of the unexposed portion (white background) after development processing, which is defined by L*, a* and b* stipulated in CIE LAB, preferably satisfies the following relationship: $L^*>88$, $-2<a^*<2$ and $-2<b^*<2$, more preferably $L^*>89$, $-1<a^*<1$ and $-1<b^*<1$, particularly preferably $L^*>89$, $-0.5<a^*<1$ and $-1<b^*<0.5$.

Silver halide grains in the silver halide emulsion which can be used in the present invention, are preferably cubic or tetradecahedral crystal grains substantially having {100} planes (these grains may be rounded at the apexes thereof and further may have planes of high order), or octahedral crystal grains. Further, a silver halide emulsion in which the proportion of tabular grains having an aspect ratio of 2 or more and composed of {100} or {111} planes accounts for 50% or more in terms of the total projected area, can also be preferably used. The term "aspect ratio" refers to the value obtained by dividing the diameter of the circle having an area equivalent to the projected area of an individual grain by the thickness of the grain. In the present invention, cubic grains, or tabular grains having {100} planes as major faces, or tabular grains having {111} planes as major faces are preferably used.

As a silver halide emulsion which can be used in the present invention, for example, silver chloride, silver bromide, silver iodobromide, or silver chloro(iodo)bromide emulsions may be used. It is preferable for a rapid processing to use a silver chloride, silver chlorobromide, silver chloroiodide, or silver chlorobromoiodide emulsions having a silver chloride content of 95 mol % or greater, more preferably said silver chloride, silver chlorobromide, silver chloroiodide, or silver chlorobromoiodide emulsions having a silver chloride content of 98 mol % or greater. Preferred of these silver halide emulsions are those having in the shell parts of silver halide grains a silver iodochloride phase of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both high sensitivity and stabilization of photographic properties are attained.

The silver halide emulsion for use in the present invention preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as alkali or alkali earth iodide salt. Alternatively, the iodide salt may be introduced by cleaving the iodide ions from an organic molecule, as described in U.S. Pat. No. 5,389,508. As another source of the iodide ion, fine silver iodide grains may be used.

The iodide salt solution may be added, concentrating in a time during grain formation, or otherwise over a certain period of time. The position of iodide ions introduced into the high chloride emulsion grains is limited for the purpose of imparting high speed and low fog to the emulsion. The more inside iodide ions are introduced into the emulsion grains, the smaller increase in sensitivity it is. Accordingly, the iodide salt solution is preferably added to the portion outer than 50%, more preferably outer than 70%, and most preferably outer than 80% of the grain volume. On the other hand, the addition of iodide salt solution is preferably finished up to the portion inner than 98%, most preferably inner than 96% of the grain volume. As mentioned above, the addition of iodide salt solution is finished at somewhat inside from the surface of grains, resulting in a high speed and low fog emulsion.

The distribution of iodide ion concentration to the depth direction inside an individual grain can be measured by means of, for example, TRIFT II type TOF-SIMS (trade name) manufactured by Phi Evans Company, in accordance with Etching/TOF-SIMS (Time of Flight-Secondary Ion Mass Spectrometry) process. The details of TOF-SIMS process are described in *Hyomen Bunseki Gijutsu Sensho Niji Ion Shitsuryobunsekiho,* editted by Nippon Hyomenkagaku Kai, Maruzen Co. Ltd. (1999). By analytical research of the emulsion grains according to the Etching/TOF-SIMS process, it is found that even though the addition of iodide salt solution has been completed up to the step of forming the inner part of final grains, there are iodide ions oozed toward the grain surface. In case where the emulsion for use in the present invention contains silver iodide, preferably, iodide ions have the maximum concentration at the grain surface, and in addition, iodide ion concentration decreases toward the inside of the grain, by analyzing with Etching/TOF-SIMS.

The silver halide emulsion grains to be used in the light-sensitive material of the present invention preferably have a silver bromide localized phase.

When the silver halide emulsion for use in the present invention contains a silver bromide localized phase, the silver bromide localized phase is preferably formed by epitaxial growth of the localized phase having a silver bromide content of at least 10 mol % on the grain surface. In addition, the emulsion grains preferably have the outermost shell portion having a silver bromide content of at least 1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium (III) chloride, iridium (III) bromide, iridium (IV) chloride, sodium hexachloroiridate (III), potassium hexachloroiridate (IV), hexaammineiridium (IV) salts, trioxalatoiridium (III) salts, and trioxalatoiridium (IV) salts. The amount of these compounds to be added can be varied in a wide range depending on the purposes, and it is preferably in the range of $10^{-9}$ to $10^{-2}$ mol per mol of silver halide.

In the present invention, ions of a transition metal are preferably added in the course of grain formation and/or growth of the silver halide grains, to include the metal ions in the inside and/or on the surface of the silver halide grains. The metal ions to be used are preferably ions of a transition metal. Preferable examples of the transition metal are iron, ruthenium, iridium, osmium, lead, cadmium or zinc. Further, 6-coordinated octahedral complex salts of these metal ions which have ligands are more preferably used. The ligand to be used may be an inorganic compound. Among the inorganic compounds, cyanide ion, halide ion, thiocyanato, hydroxide ion, peroxide ion, azide ion, nitrite ion, water, ammonia, nitrosyl ion, or thionitrosyl ion are preferably used. Such ligand is preferably coordinated to any one of metal ions selected from a group consisting of the above-mentioned iron, ruthenium, iridium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of the iron and/or ruthenium ion and the cyanide ion. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver. In case of the iridium complex, preferable ligands are fluoride, chloride, bromide and iodide ions. Among these ligands, chloride and bromide ions are more preferably used. Specifically, preferable iridium complexes are $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$.

These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, water molecule and chloride ion ligands are preferably used singly or in combination. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, these methods are preferably combined to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain-surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but they are preferably incorporated in any of a silver chloride layer (phase), a silver chlorobromide layer (phase), a silver bromide layer (phase), a silver iodochloride layer (phase) and a silver iodobromide layer (phase).

The silver halide grains contained in the silver halide emulsion for use in the present invention have an average grain size (the grain size herein refers to the diameter of the circle equivalent to the projected area of the grain, and the number average is taken as the average grain size) of preferably from 0.1 $\mu$m to 2 $\mu$m.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure by multilayer-coating of the monodisperse emulsions.

Various compounds or precursors thereof can be included in the silver halide emulsion for use in the present invention, to prevent fogging from occurring or to stabilize photographic performance, during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0 447 647 are also preferably used.

Further, in the present invention, it is preferable for enhancing storability of the silver halide emulsion to use hydroxamic acid derivatives described in JP-A-11-109576; cyclic ketones having a double bond both ends of which are substituted with an amino group or a hydroxyl group, in adjacent to a carbonyl group, as described in JP-A-11-327094 (particularly those represented by formula (SI) and the description of paragraph numbers 0036 to 0071 of JP-A-11-327094 can be incorporated herein by reference); catechols or hydroquinones each substituted with a sulfo group, as described in JP-A-11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts thereof.); hydroxyamines represented by formula (A) of U.S. Pat. No. 5,556,741 (the description of col. 4 line 56 to col. 11 line 22 of U.S. Pat. No. 5,556,741 is preferably applied to the present invention, and incorporated herein by reference), or water-soluble reducing agents represented by any one of formulas (I) to (III) of JP-A-11-102045.

Spectral sensitization can be carried out for the purpose of imparting spectral sensitivity in a desired light wavelength region to the light-sensitive emulsion in each layer of the photographic material of the present invention.

Examples of the spectral sensitizing dye which can be used in the photographic material of the present invention for spectral sensitization of blue, green and red light regions, include those disclosed by F. M. Harmer, in *Heterocyclic Compounds-Cyanine Dyes and Related Compounds,* John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The amount of these spectral sensitizing dyes to be added can be varied in a wide range depending on the occasion, and it is preferably in the range of $0.5\times10^{-6}$ mol to $1.0\times10^{-2}$ mol, more preferably in the range of $1.0\times10^{-6}$ mol to $5.0\times10^{-3}$ mol, per mol of silver halide.

The silver halide emulsion that can be used in the present invention are generally chemically sensitized.

Chemical sensitization can be performed, for example, by utilizing sulfur sensitization, represented by the addition of an unstable sulfur compound, noble metal sensitization represented by gold sensitization, and reduction sensitization, each singly or in combination thereof. Compounds that are preferably used for chemical sensitization include those described in JP-A-62-215272, from page 18, right lower column to page 22, right upper column. Of these chemical sensitization, gold-sensitized silver halide emulsion are preferred, since the fluctuation in photographic properties which may occur when scanning exposure to laser beams or the like is conducted, can be further reduced by gold sensitization.

In order to conduct gold sensitization to the silver halide emulsion that can be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, which are usable in the present invention, use can be made of bis-gold (I) methoion heterocyclic compounds, as described in JP-A-4-267249, such as bis(1,4,5-trimethyl-1,2,4-triazolium-3-thiolato) gold (I) tetrafluoroborate, organic mercapto gold (I) complexes as described in JP-A-11-218870, such as potassium bis(1-[3-2-sulfonatobenzamido] phenyl]-5-mercaptotetrazole potassium salt) aurate (I) pentahydrate, gold (I) compounds having a nitrogen compound anion coordinated thereto, as described in JP-A-4-268550, such as sodium bis(1-methylhydantoinato) aurate (I) tetrahydrate. Further, gold (I) thiolate compounds described in U.S. Pat. No. 3,503,749, gold compounds as described in JP-A-8-69074, JP-A-8-69075 and JP-A-9-269554, and compounds as described in U.S. Pat. Nos. 5,620,841, 5,912,112, 5,620,841, 5,939,245 and 5,912,111 may be also used.

The amount of these compounds to be added can be varied in a wide range depending on the occasion, and it is generally in the range of $5\times10^{-7}$ mol to $5\times10^{-3}$ mol, preferably in the range of $1.0\times10^{-6}$ mol to $1\times10^{-4}$ mol, per mol of silver halide.

Further, colloidal gold sulfide may also be used. A method of producing the colloidal gold sulfide is described in, for example, *Research Disclosure,* No. 37154, *Solid state Ionics,* Vol. 79, pp. 60 to 66 (1995), and *Compt. Rend. Hebt. Seances Acad. Sci. Sect,* B Vil. 263, p. 1328 (1996). Colloidal gold sulfide having various grain sizes are available, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

Previously known materials and additives for photography may be used for the silver halide photographic light-sensitive material of the present invention.

For example, the reflective support (herein also referred to as a reflection type support) for use in the present invention is not particularly limited, so long as the support is of reflection type. Particularly a reflective support laminated with two or more water-resisting resin layers (laminate layers) including polyethylene layers and polyester layers, at least one of said layers containing a white pigment such as titanium oxide, is preferred.

In the present invention, as a more preferable reflective support, mention can be made of a paper substrate provided thereon a polyolefin layer having micro holes at the side of coating the silver halide emulsion. Said polyolefin layer may be composed of multi-layers. In this case, more preferred are multi-layer supports comprising a polyolefin (e.g., polypropylene, polyethylene) layer adjacent to a gelatin layer at the silver halide emulsion layer side, which does not have any micro holes, and a polyolefin (e.g., polypropylene, polyethylene) layer having micro holes at the side closer to the paper substrate. A density of such multi-layered or single layered polyolefin layer located between the paper substrate and photographic constitutional layers is preferably in the range of 0.40 to 1.0 g/ml, more preferably in the range of 0.50 to 0.70 g/ml. A thickness of the multi-layered or single layered polyolefin layer located between the paper substrate and photographic constitutional layers is preferably in the range of 10 to 100 $\mu$m, more preferably in the range of 15 to 70 $\mu$m. A proportion in thickness of the polyolefin layer to the paper substrate is preferably in the range of 0.05 to 0.5, more preferably in the range of 0.1 to 0.2.

Further, it is also preferred to provide a polyolefin layer on the paper substrate at the side opposite to the photographic constitutional layers, i.e., on the back surface of the paper substrate, for a purpose of enhancing rigidity of the resultant reflective support. The polyolefin layer on the back surface is preferably polyethylene or polypropylene, whose surface is matted. The matted polypropylene is more preferred. A thickness of the polyolefin layer on the back surface is preferably in the range of 5 to 50 $\mu$m, more preferably in the range of 10 to 30 $\mu$m. A density of the polyolefin layer on the back surface is preferably in the range of 0.7 to 1.1 g/ml. Preferable embodiments of the polyolefin layer provide on a paper substrate of the reflective support for use in the present invention include, for example, those described in JP-A-10-333277, JP-A-10-333278, JP-A-11-52513, JP-A-11-65024, European Patent Nos. 0 880 065 and 0 880 066.

Further, the water-resisting resin layer preferably contains a fluorescent brightening agent. In addition, the fluorescent brightening agent may be also dispersed in a hydrophilic colloid layer of the photographic light-sensitive material. Benzoxazole-series, coumarin-series, and pyrazoline-series compounds are preferably usable fluorescent brightening agents. Benzoxazolylnaphthalene-series and benzoxazolylstilbene-series fluorescent brightening agents are more preferred. The amount of fluorescent brightening agent to be used is not particularly limited, but preferably in the range of 1 to 100 mg/m$^2$. When mixed with a water-resisting resin, a mixing ratio of the fluorescent brightening agent to the resin is preferably in the range of 0.0005 to 3% by mass, more preferably in the range of 0.001 to 0.5% by mass.

The reflection type support may be a support having, on a transmission type support or the above-mentioned reflection type support, a hydrophilic colloid layer containing a white pigment.

Alternatively, the reflection type support may be a support having a metal surface which gives mirror reflection or diffusion reflection of the second kind.

A support for use in the light-sensitive material of the present invention may be a white polyester-series support for a display purpose or a support in which a layer containing a white pigment is formed on the side having silver halide emulsion layers. In addition, in order to improve the sharpness, an anti-halation layer is preferably formed on the side having silver halide emulsion layers or the back side of the support. It is particularly preferable to set the transmission density of a support to 0.35 to 0.8 so that a display can be monitored with either reflected light or transmitted light.

In the light-sensitive material of the present invention, in order to improve e.g., sharpness of an image, a dye (particularly an oxonole-series dye) that can be discolored by processing, as described in European Patent 0 337 490 A2, page 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohol (e.g., trimethylol ethane) to a water-resisting resin layer of the support.

In the light-sensitive material of the present invention, a dye (particularly oxonole dyes and cyanine dyes) that can be discolored by processing, as described in European Patent 0 337 490 A2, pages 27 to 76, is preferably added to the hydrophilic colloid layer for the purposes of preventing both irradiation and halation, and improving safe-light immunity and the like. Further, dyes described in European Patent 0 819 977 are also preferably used in the present invention.

Some of these water-soluble dyes deteriorate color separation or safe-light immunity, if the amount of the dye to be used is increased. Preferable dyes which can be used without deteriorating color separation, are water-soluble dyes described in JP-A-5-127324, JP-A-5-127325 and JP-A-5-216185.

In the present invention, a coloring layer which can be discolored by processing, may be used in place of the water-soluble dye, or in combination with the water-soluble dye. The coloring layer which can be discolored by processing may be provided in contact with an emulsion layer directly or indirectly via an interlayer containing gelatin or a processing induced color-mixing inhibitor such as hydroquinone. The coloring layer is preferably disposed underneath (at the side closer to the support) the emulsion layer which develops the same elementary color as that of the coloring layer. Each of the coloring layers corresponding to each of the elementary colors may be disposed separately.

Only one of these coloring layers may be selectively disposed. Alternatively, a coloring layer which has been colored in accordance with a plurality of elementary color zones, may be disposed. An optical reflection density of the coloring layer is preferably 0.2 or more and 3.0 or less, more preferably 0.5 or more and 2.5 or less, and especially preferably 0.8 or more and 2.0 or less. The term "optical reflection density" herein used, refers to the value of optical density at the wavelength which gives the highest optical density in the wavelength region that is used for exposure (in case of the ordinary printer exposure, a visible light region of 400 nm to 700 nm, while in case of the scanning exposure, the wavelength of a light source used in the scanning exposure).

The coloring layer can be formed by previously known methods including, for example, a method of incorporating a dye in a hydrophilic colloid layer in the form of a dispersion of solid fine particles, as the dyes described in JP-A-2-282244, page 3 right upper column to page 8, and JP-A-3-7931, page 3 right upper column to page 11 left under column; a method of mordanting (fixing) an anionic dye to the cationic polymer; a method of adsorbing a dye on the fine particles, such as silver halide, to fix the dye in a layer; and a method of employing colloidal silver, as described in JP-A-1-239544. As the method of dispersing a fine powder of dye in the form of a solid state, for example, JP-A-2-308244, pages 4 to 13 describes a method of employing a fine powder of dye which is substantially water-insoluble at pH of at least 6 or less, but substantially water-soluble at pH of at least 8 or more. The method of fixing an anionic dye to a cationic polymer is described, for example, in JP-A-2-84637, pages 18 to 26. A method of preparing colloidal silver which is a light absorber, is described in U.S. Pat. Nos. 2,688,601 and 3,459,563. Among these methods, the method of dispersing a fine-powder of dye and the method of employing colloidal silver are preferred.

The silver halide photographic light-sensitive material of the present invention can be used for a color photographic light-sensitive material for display, a color reversal photographic printing paper, a color photographic printing paper and the like. Among these materials, the light-sensitive material of the present invention is preferably used for a color photographic printing paper.

The color photographic printing paper preferably has at least one layer of each of a yellow color-forming silver halide emulsion layer, a magenta color-forming silver halide emulsion layer and a cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer.

However, another layer arrangement which is different from the above, may be adopted.

In the present invention, a yellow coupler-containing silver halide emulsion layer may be disposed at any position on a support. However, in the case where silver halide tabular grains are contained in the yellow coupler-containing layer, it is preferable that the yellow coupler-containing layer be coated more apart from a support than at least one of a magenta coupler-containing silver halide emulsion layer or a cyan coupler-containing silver halide emulsion layer. Further, it is preferable that the yellow coupler-containing silver halide emulsion layer be coated most apart from a support of other silver halide emulsion layers, from the viewpoint of color-development acceleration, desilvering acceleration, and reduction in a residual color due to a sensitizing dye. Further, it is preferable that the cyan coupler-containing silver halide emulsion layer be disposed in the middle of other silver halide emulsion layers, from the viewpoint of reduction in blix fading. On the other hand, it is preferable that the cyan coupler-containing silver halide emulsion layer be the lowest layer, from the viewpoint of reduction in light fading. Further, each of a yellow-color-forming layer, a magenta-color-forming layer and a cyan-color-forming layer may be composed of two or three layers. It is also preferable that a color forming layer be formed by disposing a silver halide emulsion-free layer containing a coupler, in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic material and additives for processing are disclosed in JP-A-62-215272, JP-A-2-33144 and European Patent No. 0 355 660 A2. Particularly, those disclosed in European Patent No. 0355660A2 are preferably used. Further, it is also preferred to use silver halide color photographic light-sensitive materials and processing methods therefor disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent No. 0 520 457 A2.

In particular, as the above-described reflective support and the silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye stability-improving agents (stain inhibitors and discoloration inhibitors), the dyes (coloring layers), the kinds of gelatin, the layer composition of the light-sensitive material and the film pH of the light-sensitive material, those described in the publications shown in Table 1 can be preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabil- | Column 75, lines 9 to | Column 47, lines 20 to | Column 18, line 11 to |

TABLE 1-continued

| Element | JP-A-7-104448 | JP-A-7-77775 | JP-A-7-301895 |
|---|---|---|---|
| izers or anti foggants | 18 | 29 | Column 31, line 37 (Especially, mercaptoheterocyclic compounds) |
| Chemical Sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and Column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction if light-sensitive materials | Column 39, lines 11 to 26 | Column 44, lines 2 to 35 | Column 31, line 38 to Column 32, line 33 |
| pH of coating film of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers that can be used in the present invention, further, couplers described, for example, in JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP-A-0 355 660 (A2), page 4, line 15 to line 27, page 5, line 30 to page 28, the last line, page 45, line 29 to line 31, and page 47, line 23 to page 63, line 50 are also useful.

Further, it is also preferred in the present invention to add compounds represented by any of formulae (II) and (III) in WO 98/33760 and compounds represented by formula (D) described in JP-A-10-221825.

These are further specifically explained below.

As the cyan coupler which can be used in the present invention, pyrrolotriazole-series couplers are preferably used, and more specifically, couplers represented by any of formulae (I) and (II) in JP-A-5-313324 and couplers represented by formula (I) in JP-A-6-347960 are preferred. Exemplified couplers described in these publications are particularly preferred.

Further, phenol-series or naphthol-series cyan couplers are also preferred. For example, cyan couplers represented by formula (ADF) described in JP-A-10-333297 are preferred.

As cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, diphenylimidazole-series cyan couplers described in JP-A-2-33144, 3-hydroxypyridine-series cyan couplers (particularly a coupler, which is a 2-equivalent coupler formed by allowing a 4-equivalent coupler of Coupler (42) to have a chlorine coupling split-off group, and Couplers (6) and (9) enumerated as specific examples are particularly preferable) described in EP 0333185 A2 or cyclic active methylene-series cyan couplers (particularly Couplers 3, 8, and 34 enumerated as specific examples are particularly preferable) described in JP-A-64-32260; pyrrolopyrazole-type cyan couplers described in European Patent No. 0 456 226 A1; or pyrroloimidazole-type cyan coupler described in European Patent No. 0 484 909 can also be used.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference.

As the magenta coupler usable in the present invention, use can be made of 5-pyrazolone-series magenta couplers and pyrazoloazole-series magenta couplers, such as those described in the above-mentioned patent publications in the above Table. Among these, preferred are pyrazolotriazole couplers in which a secondary or tertiary alkyl group is directly bonded to the 2-, 3- or 6-position of the pyrazolotriazole ring, as described in JP-A-61-65245; pyrazoloazole couplers having a sulfonamido group in its molecule, as described in JP-A-61-65246; pyrazoloazole couplers having an alkoxyphenylsulfonamido ballasting group, as described in JP-A-61-147254; and pyrazoloazole couplers having a 6-positioned alkoxy or aryloxy group, as described in European Patent No. 0 226 849 A2 and 0 294 785 A, in view of the hue and stability of an image to be formed therefrom and color-forming property of the couplers.

Particularly as the magenta coupler, pyrazoloazole couplers represented by formula (M-I) described in JP-A-8-122984 are preferred. The descriptions of paragraph Nos. 0009 to 0026 of the publication JP-A-8-122984 can be entirely and preferably applied to the present invention, and therefore they are incorporated herein by reference.

In addition, pyrazoloazole couplers having a steric hindrance group at both the 3- and 6-positions, as described in European Patent Nos. 845 384 and 884 640, are also preferably used.

As the yellow coupler, also preferably used in the present invention are acylacetamide-type yellow couplers in which the acyl group has a 3-membered to 5-membered cyclic structure, as described in European Patent No. 0 447 969 A1; malondianilide-type yellow couplers having a cyclic structure, as described in European Patent No. 0482552 A1; pyrrole-2 or 3-yl or indole-2 or 3-ylcarbonylacetic anilide-series couplers, as described in European Patent Nos. 953 870 A1, 953 871 A1, 953 872 A1, 953 873 A1, 953 874 A1 and 9 538 754 A1; acylacetamide-type yellow couplers having a dioxane structure, as described in U.S. Pat. No. 5,118,599, in addition to the compounds described in the above-mentioned table. Above all, acylacetamide-type yellow couplers in which the acyl group is a 1-alkylcyclopropane-1-carbonyl group, and malondianilide-type yellow couplers in which one of the anilido groups constitutes an indoline ring are especially preferably used. These couplers may be used singly or as combined.

It is preferred that the coupler for use in the present invention is also pregnated into a loadable latex polymer (described, for example, in U.S. Pat. No. 4,203,716) in the presence (or absence) of the above high boiling point organic solvent, or the coupler is dissolved in the presence (or absence) of the foregoing high boiling point organic solvent with a polymer insoluble in water but soluble in an organic solvent, and then the resultant coupler is emulsified and dispersed into an aqueous hydrophilic colloid solution.

The water-insoluble but organic solvent-soluble polymers which can be preferably used, include the homo-polymers and co-polymers disclosed in U.S. Pat. No. 4,857,449, from column 7 to column 15, and WO 88/00723, from page 12 to page 30. The use of methacrylate-series or acrylamide-series polymers is more preferable, and especially the use of acrylamide-series polymers is further preferable, in view of color image stabilization and the like.

In the present invention, known color mixing-inhibitors may be used. Among these compounds, those described in the following publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19 629 142 A1, may be used. Further, in order to accelerate a developing speed by increasing the pH of a developing solution, redox compounds described in, for example, German Patent Nos. 19 618 786 A1 and 19 806 846 A1, European Patent Nos. 0 839 623 A1 and 0 842 975 A1, and French Patent No. 2 760 460 A1, are also preferably used.

In the present invention, as an ultraviolet absorber, it is preferred to use compounds having a high molar extinction coefficient. Examples of these compounds include those having a triazine skeleton. Among these compounds, use can be made of those described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, JP-T-8-501291 ("JP-T" means searched and published International patent application), European Patent No. 0 711 804 A1 and German Patent No. 19 739 797 A. The ultraviolet absorber is preferably added to the light-sensitive layer or/and the light-nonsensitive layer.

As the binder or hydrophilic colloid which can be used in the light-sensitive material of the present invention, gelatin is preferred advantageously, but another hydrophilic colloid can be used singly or in combination with gelatin. In particular, it is preferable for the gelatin for use in the present invention that the content of heavy metals, such as Fe, Cu, Zn and Mn, as impurities therein be reduced to 5 ppm or below, more preferably 3 ppm or below.

Further, the amount of calcium contained in the light-sensitive material of the present invention is preferably 20 $mg/m^2$ or less, more preferably 10 $mg/m^2$ or less, and most preferably 5 $mg/m^2$ or less.

In the present invention, it is preferred to add an antibacterial (fungi-preventing) agent and anti-mold agent as described in JP-A-63-271247, in order to destroy various kinds of molds and bacteria which propagate themselves in a hydrophilic colloid layer and deteriorate the image.

Further, the pH of the film of the light-sensitive material of the present invention is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is preferred.

The amount of the surface-active agent to be added limited, but generally in the range of $1\times10^{-5}$ to 1 $g/m^2$, preferably in the range of $1\times10^{-4}$ to $1\times10^{-1}$ g/m$^2$, more preferably in the range of $1\times10^{-3}$ to $1\times10^{-2}$ g/m$^2$.

The fluorine-containing surface-active agent may be used singly or in combination with known another surface-active agent. The fluorine-containing surfactant is preferably used in combination with known another surface-active agent.

The light-sensitive material of the present invention can preferably be used, in addition to the printing system using a general negative printer, in a scanning exposure system using the cathode rays (CRT). The cathode ray tube exposure apparatus is simpler and more compact, and therefore less expensive than a laser-emitting apparatus. Further, optical axis and color (hue) can easily be adjusted.

In a cathode ray tube which is used for image-wise exposure, various light-emitting materials which emit a light in the spectral region, are used as occasion demands. For example, any one of red light-emitting materials, green light-emitting materials, blue light-emitting materials, or a mixture of two or more of these light-emitting materials may be used. The spectral region are not limited to the above red, green and blue, and fluorophores which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, color image signals may be input into a cathode ray tube to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface (area) successive exposure, may be used. Generally, among these methods the surface (area) successive exposure is preferred, from the viewpoint of high image quality enhancement, because a cathode ray tube of high resolution can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor or a solid state laser using a semiconductor as an excitation light source. It is preferred to use a semiconductor laser, or a second harmonic generation light source (SHG) comprising a combination of nonlinear optical crystal with a semiconductor or a solid state laser, to make the system more compact and inexpensive. Particularly, to design a compact and inexpensive apparatus having a longer duration of life and high stability, use of a semiconductor laser is preferable; and it is preferred that at least one of exposure light sources should be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photographic material in normal three wavelength regions of blue, green and red.

The exposure time in such a scanning exposure is defined as the period of time necessary to expose the size of the picture element (pixel) with the density of the picture element being 400 dip, and preferred exposure time is $10^{-4}$ sec or less and more preferably $10^{-6}$ sec or less.

The scanning exposure system which can preferably be used for the present invention is described in detail in the patent publications as shown in the above table.

With respect to the processing method of the photographic material of the present invention, processing materials and processing methods as disclosed in JP-A-2-207250, from page 26, right under column, line 1 to page 34, right upper column, line 9, and JP-A-4-97355, from page 5, left upper column, line 17 to page 18, right under column, line 20, can be preferably applied. Further, as preservatives which are used in the developing solution, compounds described in the patent publications as shown in the above table are preferably used.

The present invention can be also preferably applied to a light-sensitive material having a rapid processing suitability.

The term "color developing time" as used herein refers to a period of time required from the beginning of dipping a light-sensitive material into a color developing solution until the light-sensitive material is dipped into a blix solution in the subsequent processing step. In the case where a processing is carried out using, for example, an autoprocessor, the color developing time is the sum total of both a time in which a light-sensitive material has been dipped in a color developing solution (so-called "time in the solution") and a time in which the light-sensitive material has been conveyed in air toward a bleach-fixing bath in the step subsequent to color development (so-called "time in the air"). Likewise, the term "blix time" as used herein refers to a period of time required from the beginning of dipping a light-sensitive material into a blix solution until the light-sensitive material is dipped into a washing bath or a stabilizing bath in the subsequent processing step. Further, the term "washing or stabilizing time" as used herein refers to a period of time required from the beginning of dipping a light-sensitive material into a washing solution (water) or a stabilizing solution until the end of the dipping toward a drying step (so-called "time in the solution").

In the case where a rapid processing is carried out in the present invention, the color developing time is preferably 60 sec or less, more preferably from 50 sec to 6 sec, further preferably from 30 sec to 6 sec. Likewise, the blix time is preferably 60 sec or less, more preferably from 50 sec to 6 sec, further preferably from 30 sec to 6 sec. Further, the washing or stabilizing time is preferably 150 sec or less, more preferably from 130 sec to 6 sec.

Examples of a development method applicable to the photographic material of the present invention after exposure, include a conventional wet system, such as a development method using a developing solution containing an alkali agent and a developing agent, a development method wherein a developing agent is incorporated in the photographic material and an activator solution, e.g., a developing agent-free alkaline solution is employed for the development, as well as a heat development system using no processing solution. In particular, the activator method using a developing agent-free alkaline solution is preferred over the other methods, because the processing solution contains no developing agent, thereby it enables easy management and handling of the processing solution and reduction in loading by waste solution processing to make for environmental preservation.

Examples of the preferable developing agents or their precursors incorporated in the photographic materials in the case of adopting the activator method, include the hydrazine-type compounds described in, for example, JP-A-8-234388, JP-A-9-152686, JP-A-9-152693, JP-A-9-211814 and JP-A-9-160193.

Further, the development processing method in which the photographic material reduced in the amount of silver to be coated undergoes the image amplification processing using hydrogen peroxide (intensification processing) can be employed preferably. In particular, it is preferable to apply this processing method to the activator method. Specifically, the image-forming methods utilizing an activator solution containing hydrogen peroxide, as disclosed in JP-A-8-297354 and JP-A-9-152695, can be preferably used.

Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure,* Item 36544, pp. 536–541 (September 1994), and JP-A-8-234388 can be used in the present invention.

It is preferred to use a band stop filter, as described in U.S. Pat. No. 4,880,726, when the photographic material of the present invention is subjected to exposure with a printer. Color mixing of light can be excluded and color reproducibility is remarkably improved by the above means.

In the present invention, a yellow micro dot pattern may be previously formed by pre-exposure before giving an image information, to thereby perform a copy restraint, as described in European Patent Nos. 0 789 270 A1 and 0 789 480 A1.

The light-sensitive material of the present invention can be preferably used in combination with the exposure and development system described in the following publications:

Automatic printing and development system described in JP-A-10-333253;

Conveyor of light-sensitive materials, as described in JP-A-2000-10206;

Recording system including an image-reading apparatus, as described in JP-A-11-215312;

Exposure system including color image-recording system, as described in JP-A-11-88619 and JP-A-10-202950;

Digital photo-printing system including remote diagnostic system, as described in JP-A-10-210206; and Photo-printing system including an image-recording apparatus, as described in Japanese Patent Application No. 10-159187.

The silver halide photographic light-sensitive material of the present invention exhibits the following excellent effects: an excellent white background can be attained without affecting the intrinsic image-forming capability; both light- and heat-resistance of the white background, as well as stability during and after the processing, are excellent; and such a light-sensitive material can be produced in a simple process. Further, in the silver halide photographic light-sensitive material of the present invention, a hue of the image obtained from the light-sensitive material can be adjusted arbitrarily, while maintaining the above-mentioned effects. The silver halide photographic light-sensitive material of the present invention from which the thus-improved white background portion can be attained, is, particularly, useful as a photographic printing paper.

The present invention is described in more detail with reference to the following examples, but the invention is not limited thereto.

EXAMPLES

Example 1

Both surfaces of a paper were laminated with a polyethylene resin, in which the polyethylene laminate at the side of coating the following first layer contained a white pigment ($TiO_2$), a fluorescent brightening agent and a blue-tinting pigment (ultramarine blue). After corona discharge treatment was performed on the surface of the thus-prepared support (Support A), a gelatin subbing layer containing sodium dodecylbenzenesulfonate was formed on that surface. Thereon, photographic constitutional layers composed of the first layer to the seventh layer were further coated successively, to prepare a silver halide color photographic light-sensitive material sample (Sample 101) having the layer structure shown below. Coating solutions used for each of the photographic constitutional layers were prepared in the following manners.

Preparation of Coating Solution for First Layer (Preparation of Emulsified dispersion A)

57 g of a yellow coupler (ExY), 7 g of a dye image stabilizer (Cpd-1), 4 g of a dye image stabilizer (Cpd-2), 7 g of a dye image stabilizer (Cpd-3) and 2 g of a dye image stabilizer (Cpd-8) were dissolved in 21 g of a solvent (Solv-1) and 80 ml of ethyl acetate, and the resultant solution was added to 220 g of an aqueous 23.5% by mass gelatin solution containing 4 g of sodium dodecylbenzenesulfonate. The resultant mixture was emulsified and dispersed by a high speed stirring emulsifier (DISOLVER), followed by addition of water, to prepare 900 g of Emulsified dispersion A.

(Preparation of Emulsion A)

To 1.06 liter of deionized-distilled water containing 5.7% by mass of deionized-gelatin, 46.3 ml of an aqueous 10% NaCl solution, 46.4 ml of 1 N $H_2SO_4$ and 0.012 g of the following Compound A were added in this order. Then, the temperature of the resultant mixture solution in a reaction vessel was adjusted to 50° C. Immediately thereafter, 0.1 mol of silver nitrate and 0.1 mol of NaCl were added to the reaction vessel, while stirring with high speed, over 10 minutes, to form core grains. Subsequently, an aqueous solution containing 1.5 mol of silver nitrate and an aqueous solution containing 1.5 mol of NaCl were added, over 60 minutes, according to a flow rate-accelerating method so that the final addition rate was 4 times the initial addition rate. In this way, the first shell was formed on the core grains. Then, an aqueous solution containing 0.2 mol % of silver nitrate and an aqueous solution containing 0.2 mol % of NaCl were added, over 6 minutes, at the constant addition rate, to form the second shell. At that time, $K_4IrCl_6$, $K_4Ir(H_2O)Cl_5$, and $K_4Ir(thiazole)Cl_5$ were added to the aqueous NaCl solution in amounts of $1\times10^{-8}$ mol, $5\times10^{-7}$ mol, and $2\times10^{-6}$ mol, to the total amount of silver to be used, respectively, to dope them in the silver halide grains.

Further, an aqueous solution containing 0.2 mol of silver nitrate, an aqueous solution containing 0.16 mol of NaCl and an aqueous solution containing 0.04 mol of KBr were added, over 6 minutes, to form the third shell. At that time, $K_4Ru(CN)_6$ was dissolved in the halide aqueous solution in an amount corresponding to $1\times10^{-5}$ mol to the total amount of silver to be used, thereby including the ruthenium complex in the silver halide grains.

Further, during growth of the grains at this final stage, an aqueous solution of KI in an amount corresponding to 0.003 mol to the total amount of silver to be used, was added to the reaction vessel, over 1 minute. Addition of the KI solution was started from the time when formation of 93% of the total grains was completed, and the addition was finished at the time when formation of 95% of the total grains was completed.

Thereafter, a flocculant (precipitating agent) of the following Compound B was added thereto at 40° C., and then pH was adjusted to about 3.5, to conduct desalting and washing.

To the resultant emulsion after desalting and washing, an aqueous solution of deionized-gelatin, an aqueous solution of NaCl and an aqueous solution of NaOH were added. Subsequently the temperature was increased to 50° C. to adjust pAg and pH to 7.6 and 5.6, respectively.

In this way, an emulsion A containing cubic silver halide grains (halogen composition: AgCl 97.8 mol %, AgBr 2 mol %, AgI 0.2 mol %; average grain size (side length): 0.41 μm; coefficient of variation of grain size (side length): 8%) was prepared.

To the above-mentioned emulsion kept at 50° C., the following spectral sensitizing dye-1 and spectral sensitizing dye-2 were added in the amounts of $3\times10^{-4}$ mol and $3\times10^{-5}$ mol, per mol of Ag, respectively. Further, $1\times10^{-5}$ mol/mol of Ag of sodium phenylthiosulfonate and a fine grain emulsion (average grain size: 0.05 μm; halogen composition: AgBr 90 mol %, AgCl 10 mol %; a hexachloroiridate compound was doped in the fine grains) were added in this order, and the resultant emulsion was subjected to ripening for 15 minutes. The added fine grains were dissolved so as to increase the silver bromide content of the host cubic grains to 2.7 mol %. The hexachloroiridate compound was doped in an amount of $1\times10^{-7}$ mol per mol of Ag.

Subsequently, $1\times10^{-5}$ mol of sodium thiosulfate and $2\times10^{-5}$ mol of the following gold sensitizer-1 were added, per mol of Ag, respectively. Immediately after that, the temperature of the resultant admixture was raised to 60° C., followed by ripening for 40 min, then cooling to 50° C. Immediately after the cooling, the following mercapto compounds-1 and -2 were added in the amounts of $6\times10^{-4}$ mol, per mol of Ag, respectively. After ripening for 10 minutes, a KBr aqueous solution was added thereto in an amount of 0.008 mol, per mol of Ag, and followed by ripening again for 10 minutes. Thereafter, the temperature was lowered, to store the completed emulsion. In this way, the finished emulsion A was prepared.

Compound A

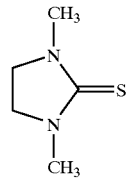

Compound B

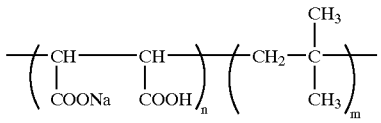

Each of n and m represents an integer

Spectral sensitizing dye-1

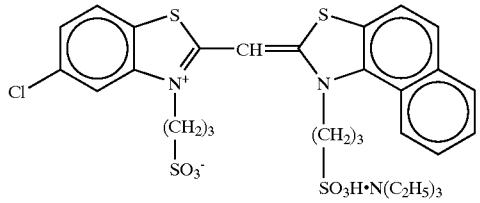

Spectral sensitizing dye-2

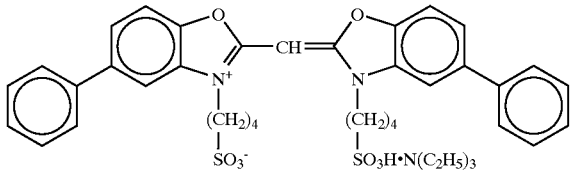

Mercapto compound-1

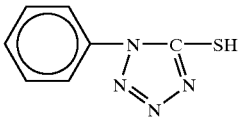

Mercapto compound-2

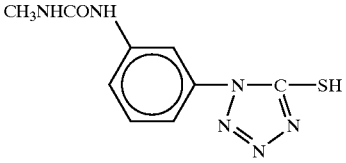

Gold sensitizer-1

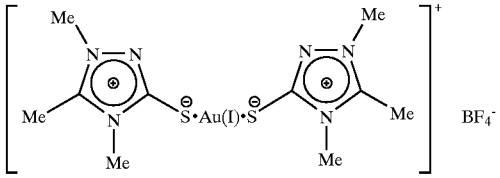

(Preparation of the First-Layer Coating Solution)

The above emulsified dispersion A and the above emulsion A were mixed and dissolved each other, and a first-layer coating solution was prepared so that it would have the composition shown below. The coating amount of the emulsion is in terms of silver.

The coating solutions for the second layer to the seventh layer were prepared in the similar manner as that for the first-layer coating solution. As the gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

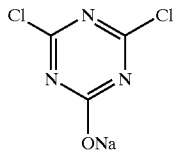

(Used in 1.4 mass % per gelatin)

(H-2) Hardener

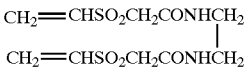

(H-3) Hardener

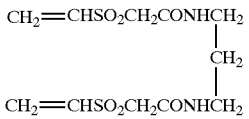

(Ab-1) Antiseptic

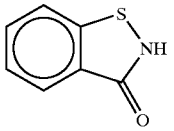

(Ab-2) Antiseptic

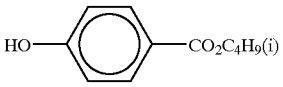

-continued (Ab-3) Antiseptic

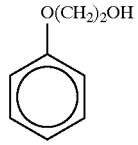

(Ab-4) Antiseptic

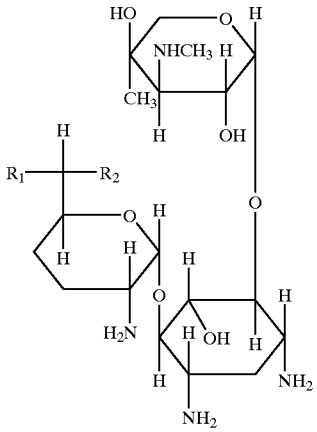

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c and d

For the silver chlorobromide emulsions of the green- and red-sensitive emulsion layers, the following spectral sensitizing dyes were used.

Green-Sensitive Emulsion Layer (Sensitizing dye D)

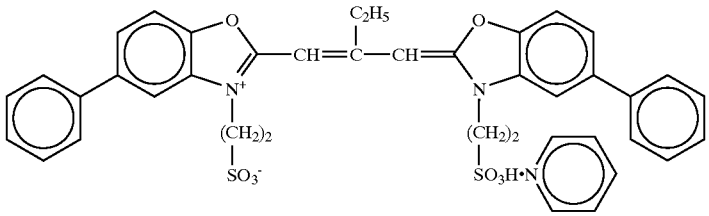

(Sensitizing dye E)

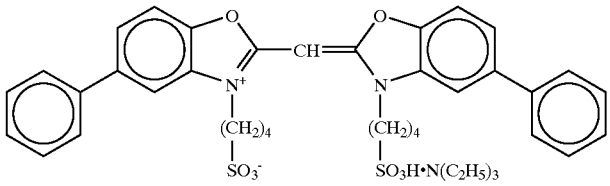

(Sensitizing dye F)

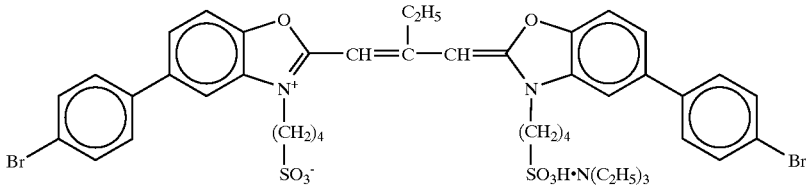

(The sensitizing dye D was added, to the large-size emulsion in an amount of $3.0\times10^{-4}$ mol, per mol of silver halide, and to the small-size emulsion in an amount of$3.6\times10^{-4}$ mol, per mol of silver halide. Further, the sensitizing dye E was added to the large-size emulsion in an amount of $4.0\times10^{-5}$ mol, per mol of silver halide, and to the small-size emulsion in an amount of $7.0\times10^{-5}$ mol, per mol of silver halide. Further, the sensitizing dye F was added to the large-size emulsion in an amount of $2.0\times10^{-4}$ mol, per mol of silver halide, and to the small-size emulsion in an amount of $2.8\times10^{-4}$ mol, per mol of silver halide)

Red-Sensitive Emulsion Layer (Sensitizing dye G)

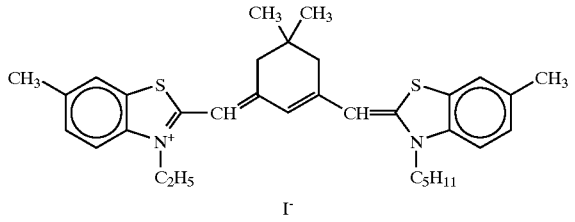

(Sensitizing dye H)

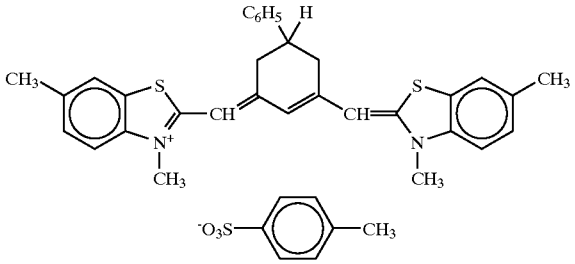

(The sensitizing dyes G and H were added, respectively, to the large-size emulsion in an amount of $8.0\times10^{-5}$ mol, per mol of silver halide, and to the small-size emulsion in an amount of $10.7\times10^{-5}$ mol, per mol of silver halide.)

Further, the following compound I was added to the red-sensitive emulsion layer in an amount of $3.0\times10^{-3}$ mol per mol of the silver halide.

(Compound I)

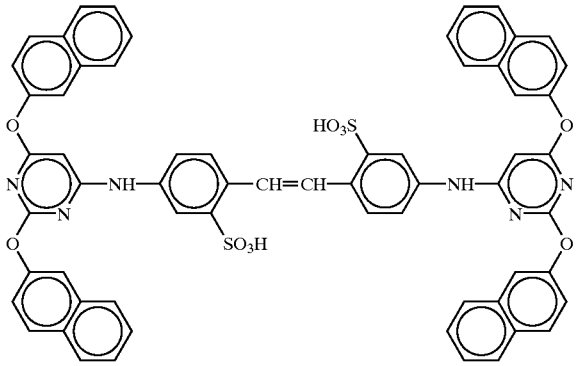

Further, to the green-sensitive emulsion layer and the red-sensitive emulsion layer, was added 1-(3-methylureidophenyl)-5-mercaptotetrazole in amounts of $1.0\times10^{-3}$ mol and $5.9\times10^{-4}$ mol, respectively, per mol of the silver halide. Further, the compound was also added to the second layer, the forth layer, the sixth layer, and the seventh layer, in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, in order to prevent irradiation, the following dyes (coating amounts are shown in parentheses) were added.

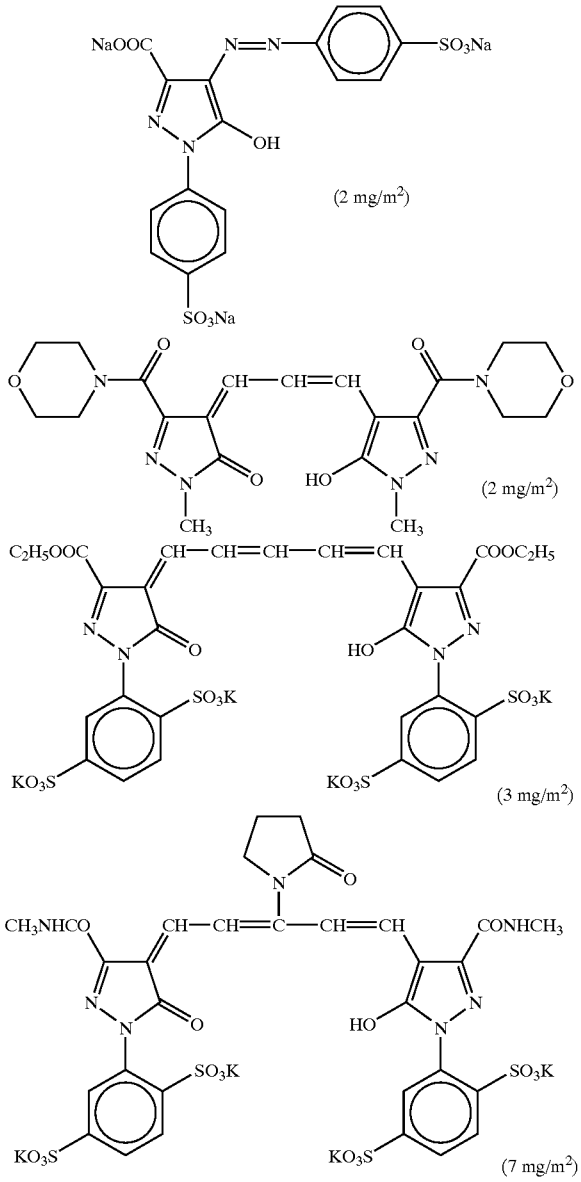

(Layer Constitution)

The composition of each layer is shown below. The numbers show coating amounts (g/m$^2$). In the case of the silver halide emulsion, the coating amount is in terms of silver.

Support

Polyethylene Resin-Laminated Paper (Support A)

[The polyethylene resin on the first layer side contained a white pigment ($TiO_2$; content of 16 wt %, ZnO; content of 4 wt %), a fluorescent whitening agent (4,4'-bis(5-methylbenzoxazolyl)stilbene; content of 0.03 wt %) and a bluish dye (ultramarine blue)]

First Layer (Blue-Sensitive Emulsion Layer)

| | |
|---|---|
| Emulsion A | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |

Second Layer (Color-Mixing Inhibiting Layer)

| | |
|---|---|
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |

Third Layer (Green-Sensitive Emulsion Layer)

Silver chlorobromide emulsion B (gold- and sulfur-sensitized cubes, a 1:3 mixture of a large-size emulsion having an average grain size of 0.45 μm, and a small-size emulsion having an average grain size of 0.35 μm (in terms of mol of silver). The deviation coefficients of the grain size distributions were 0.10 and 0.80, respectively. Each emulsion had 0.15 mol % of silver iodide contained in the vicinity of the grain surface and 0.4 mol % of silver bromide contained locally in part of the grain surface.) 0.14

| | |
|---|---|
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |

Fourth Layer (Color-Mixing Inhibiting Layer)

| | |
|---|---|
| Gelatin | 0.71 |
| Color-mixing inhibiting agent (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |

-continued

| | |
|---|---|
| Solvent (Solv-1) | 0.04 |
| Solvent (Solv-2) | 0.16 |

Fifth Layer (Red-Sensitive Emulsion Layer)

Silver chlorobromide emulsion C (gold- and sulfur-sensitized cubes, a 5:5 mixture of a large-size emulsion having an average grain size of 0.40 μm, and a small-size emulsion having an average grain size of 0.30 μm (in terms of mol of silver). The deviation coefficients of the grain size distributions were 0.09 and 0.11, respectively. Each emulsion had 0.1 mol % of silver iodide contained in the vicinity of the grain surface and 0.8 mol % of silver bromide contained locally in part of the grain surface.)

| | |
|---|---|
| | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |

Sixth Layer (Ultraviolet Absorbing Layer)

| | |
|---|---|
| Gelatin | 0.46 |
| Ultraviolet absorbing agent (UV-B) | 0.45 |
| Compound (S1-4) | 0.0015 |
| Solvent (Solv-7) | 0.25 |

Seventh Layer (Protective Layer)

| | |
|---|---|
| Gelatin | 0.70 |
| Acryl-modified copolymer of polyvinyl alcohol (the degree of modification: 17%) | 0.04 |
| Liquid paraffin | 0.02 |
| Surface-active agent (Cpd-13) | 0.01 |

(E x Y) Yellow coupler

A mixture of 70:30 (molar ratio) of

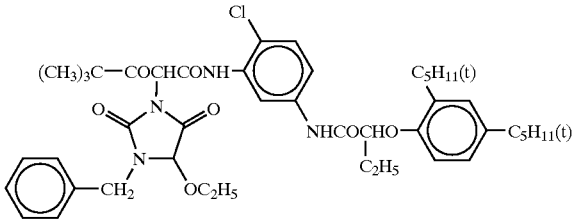

and

-continued
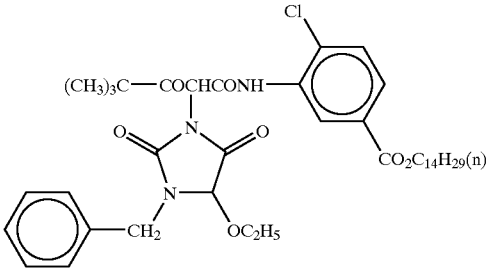
(E x M) Magenta coupler
A mixture in 40:40:20 (molar ration) of
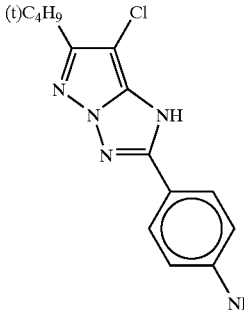
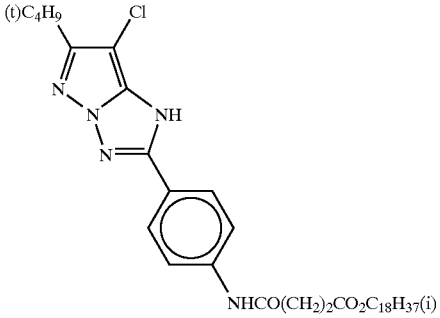
and
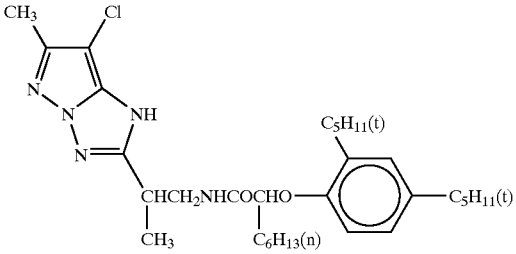
(E x C-2) Cyan coupler
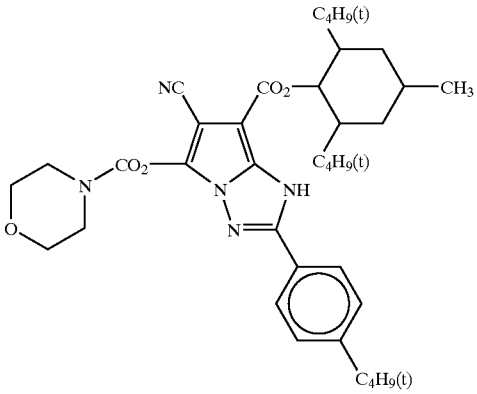
-continued
(E x C-3) Cyan coupler
A mixture in 50:25:25 (molar ratio) of
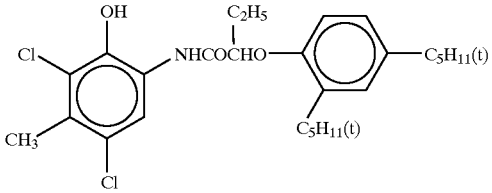
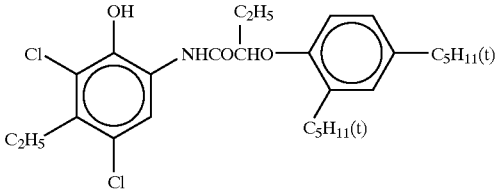
and
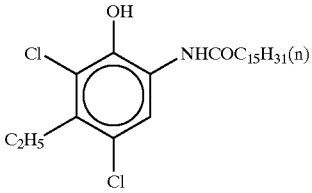
(Cpd-1) Color-image stabilizer
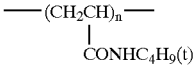
number-average molecular weight 60,000
(Cpd-2) Color-image stabilizer
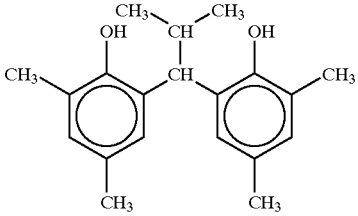
(Cpd-3) Color-image stabilizer
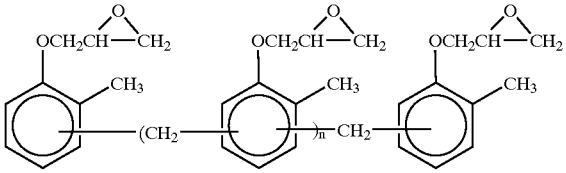
n = 7~8 (average value)
(Cpd-4) Color-image inhibitor
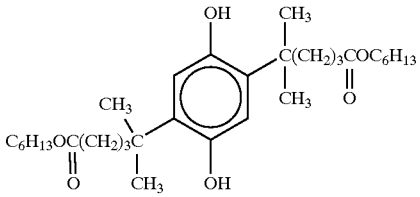
(Cpd-5) Color-image stabilizer
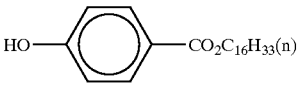

-continued
(Cpd-6) Color-image stabilizer
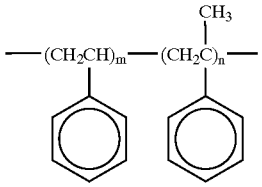
number-average molecular weight 600
m/n = 10/90
(Cpd-7) Color-image stabilizer
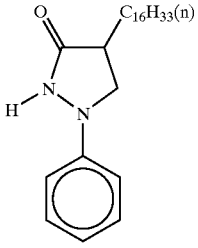
(Cpd-8) Color-image stabilizer
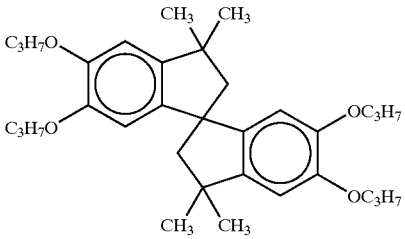
(Cpd-9) Color-image stabilizer
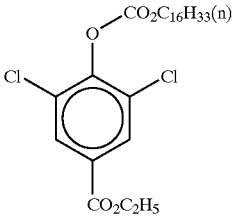
(Cpd-10) Color-image stabilizer
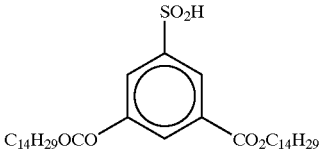
(Cpd-11)
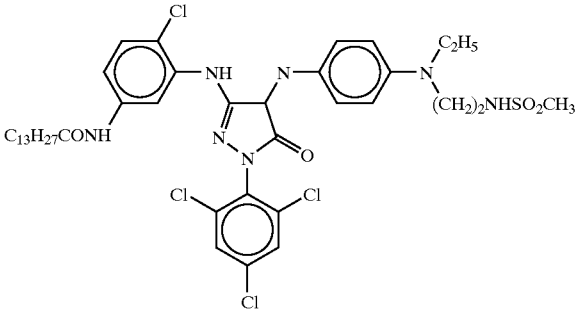
-continued
(Cpd-13) Surfactant
A mixture in 7:3 (molar ratio) of
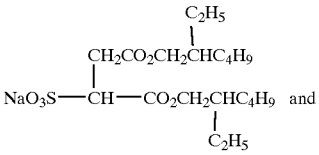
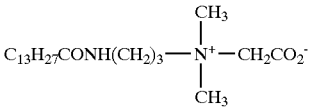
(Cpd-14)
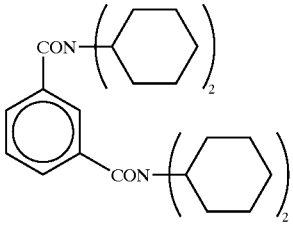
(Cpd-15)
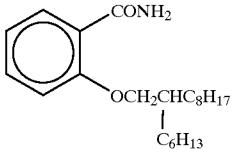
(Cpd-16)
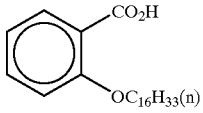
(Cpd-17)
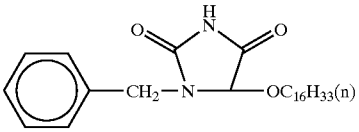
(Cpd-18)
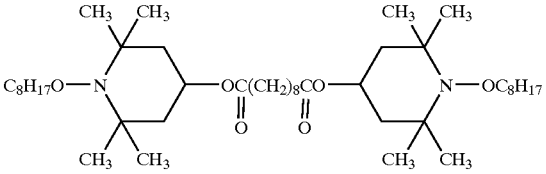
(Cpd-19) Color-mixing inhibitor
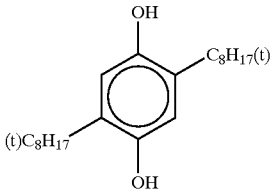
(UV-1) Ultraviolet absorber
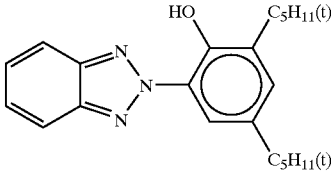

-continued (UV-2) Ultraviolet absorber

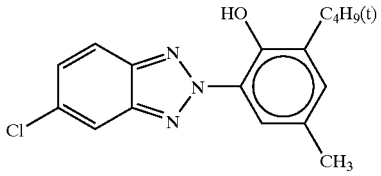

(UV-3) Ultraviolet absorber

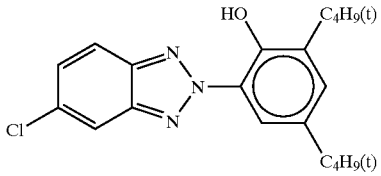

(UV-4) Ultraviolet absorber

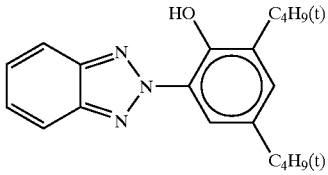

(UV-5) Ultraviolet absorber

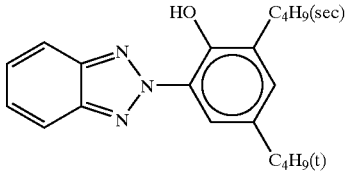

(UV-6) Ultraviolet absorber

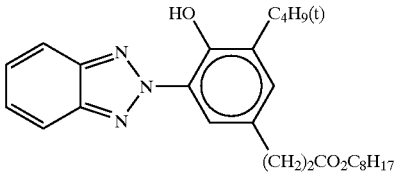

(UV-7) Ultraviolet absorber

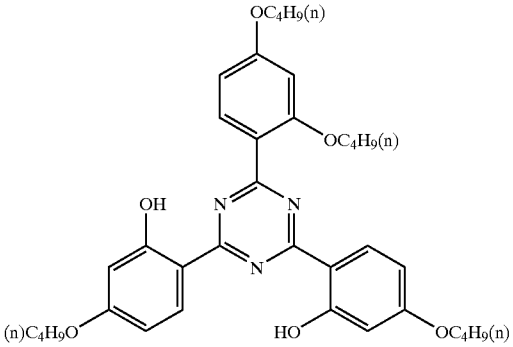

UV-A: A mixture of UV-1/UV-2/UV-3/UV-4=4/2/2/3 (weight ratio)

UV-B: A mixture of UV-1/UV-2/UV-3/UV-4/UV-5/UV-6=9/3/3/4/5/3 (weight ratio)

UV-C: A mixture of UV-2/UV-3/UV-6/UV-7=1/1/1/2 (weight ratio)

(Solv-1)

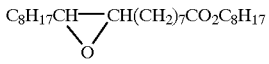

(Solv-2)

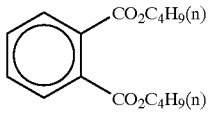

(Solv-3)

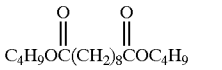

(Solv-4)

(Solv-5)

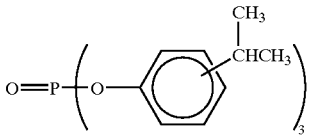

(Solv-7)

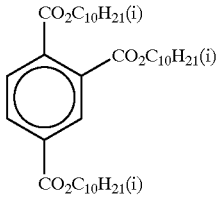

(Solv-8)

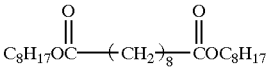

(S1-4)

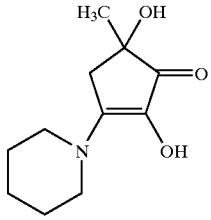

Using a HIE-type sensitometer for high illumination intensity exposure, manufactured by Yamashita Denso Corporation, gradation exposure for sensitometry was given to the thus-obtained coated sample 101. At that time, to the sample was given blue exposure for sensitometry through a band pass filter which passes light of 420 nm to 475 nm, a green exposure for sensitometry through a band pass filter which passes light of 505 nm to 575 nm, and a red exposure for sensitometry through a sharp cut filter which passes light longer than the wavelength of 605 nm. The thus-exposed sample was processed with the following color development processing A.

The processing steps will be hereinafter explained.

(Processing A)

The aforementioned light-sensitive material was made into a roll with a width of 127 mm; the resultant sample was exposed to light imagewise, using a mini-lab printer processor PP1258AR (trade name) manufactured by Fuji Photo Film Co., Ltd.; and then, the exposed sample was continuously processed (running test) in the following processing steps, until the replenishment reached to be equal to twice the color development tank volume. The process using the thus-obtained running solution was designated as Processing A.

| Processing step | Temperature | Time | Replenishment rate* |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **33.0° C. | 30 sec | 121 ml |

*Replenishment rate per $m^2$ of the light-sesitive material to be processed.
**A rinse cleaning system RC50D (trade name), manufactured by Fuji Photo Film Co., Ltd., was installed in the rinse (3), and the rinse solution was taken out from the rinse (3), to send to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount
of 50 to 300 ml/min, and the rinse solution was circulated under controlled temperature for 10 hours a day. (The rinse was made in a tank counter-current system from (1) to (4).)

The composition of each processing solution was as follows.

| (Color developer) | (Tank solution) | (Replenisher) |
|---|---|---|
| Water | 800 ml | 800 ml |
| Dimethylpolysiloxane-series surfactant (Silicone KF351A/ trade name, manufactured by Shin-Etsu Chemical Co., Ltd.) | 0.1 g | 0.1 g |
| Tri(isopropanol)amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-Disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF/trade name, manufactured by Showa Chemical Industry Co., Ltd.) | 2.5 g | 5.0 g |
| Sodium sulfite | 0.1 g | 0.1 g |
| Disodium-N,N-bis(sulfonatoethyl) Hydroxylamine | 8.5 g | 11.1 g |
| N-ethyl-N-(β-Methanesulfonamidoethyl)-3-methyl-4-amino-4-aminoaniline · 3/2 sulfuric acid ·1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |
| (Bleach-fixing solution) | (Tank solution) | (Replenisher) |
| Water | 700 ml | 600 ml |
| Ethylenediaminetetraacetic acid iron (III) ammonium | 47.0 g | 94.0 g |
| Ethylenediamine tetraacetic acid | 1.4 g | 2.8 g |
| m-Carboxybenzenefulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |
| (Rinse solution) | (Tank solution) | (Replenisher) |

-continued

| (Color developer) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| PH | 6.5 | 6.5 |

After processing, the unexposed portion (white background) of the processed sample 101 was measured using a spectro-colorimeter. Both brightness and hue of the white background can be measured by the apparatus, according to the stipulation in CIE LAB. The stipulation defines a white color using the following three quantitative value:

L* represents a brightness. The larger the value is, the brighter the obtained white color is.

a* stipulates a hue. In this case, as the value becomes larger, it means a warmer color. In other words, the red color is more inclined to turn magenta. On the other hand, as the value becomes smaller, it means a cooler color. In other words, the cyan color is more inclined to turn green.

b* also stipulates a hue. In this case, as the value becomes larger, it means the resultant hue is more inclined to become yellow. On the other hand, as the value becomes smaller, it means the resultant hue is more inclined to become blue.

Then, the support B was prepared in the same manner as the support A used in the sample 101, except that an ultramarine blue was omitted from the support A.

Sample 102 was prepared in the same manner as the sample 101, except that the support A was replaced by the support B. In addition, sample 103 was prepared in the same manner as the sample 102, except that the coating solution for the first layer in the sample 102 was replaced by the following first-layer coating solution containing an emulsified dispersion B described below. The emulsified dispersion B was obtained, by mixing the blue pigment according to the present invention together with photographically useful substances, in an organic solvent, and then emulsifying and dispersing the resulting mixture.

Preparation of First-layer Coating Solution Containing a Pigment.

57 g of the yellow coupler (ExY), 7 g of the dye image stabilizer (Cpd-1), 4 g of the dye image stabilizer (Cpd-2), 7 g of the dye image stabilizer (Cpd-3), 2 g of the dye image stabilizer (Cpd-8), 0.2 g of Blue A3R-K (trade name, manufactured by Ciba Specialty Chemicals), and 0.13 g of Violet B-K (trade name, manufactured by Ciba Specialty Chemicals) were mixed together with 21 g of the solvent (Solv-1) and 80 ml of ethyl acetate, to form an uniform mixture solution. The resulting solution was emulsified and dispersed in 220 g of a 23.5% by mass-gelatin aqueous solution containing 4 g of sodium dodecylbenzenesulfonate, using a high speed stirring emulsifier (DISOLVER), followed by addition of water, to prepare 900 g of Emulsified dispersion B.

In the similar way to the sample 103, pigments were incorporated in the layers, as specified in Table 2, in the amount, as described in Table 2, to prepare a variety of the tinted samples. Similarly to the sample 101, these samples were also processed, and then hue of the resultant white background portion in each of the samples, was measured, according to the stipulation in CIE LAB. The results which were obtained are shown in Table 2.

Sensorial evaluation of the white background shown in Table 3 was conducted according to the following criterion:

Sensorial Evaluation of White Background.

| | |
|---|---|
| ⊚ | Very white. |
| ○ | White. |
| ▲ | Nearly white that is allowable as a white background |
| X | Poor white that is not allowable as a white background |

TABLE 2

| | Pigment | | | | | | | | Sensorial |
|---|---|---|---|---|---|---|---|---|---|
| | BlueA3R-K | Violet B-K | Ultramarine Blue | | Pigment-coating | CIE LAB Measurement | | | evaluation of white |
| Sample | mg/m$^2$ | mg/m$^2$ | mg/m$^2$ | Support | Layer | L* | a* | b* | background |
| 101 | 0.0 | 0.0 | 103 | A | Support | 89.4 | 0.35 | −1.42 | ⊚ |
| 102 | 0.0 | 0.0 | 0 | B | — | 93.4 | −0.20 | 2.85 | X |
| 103 | 2.0 | 1.3 | 0 | B | First Layer | 90.6 | 0.45 | −1.20 | ⊚ |
| 104 | 2.0 | 1.3 | 0 | B | Second Layer | 90.7 | 0.44 | −1.21 | ⊚ |
| 105 | 2.0 | 1.3 | 0 | B | Third Layer | 90.6 | 0.45 | −1.20 | ⊚ |
| 106 | 2.0 | 1.3 | 0 | B | Forth Layer | 90.6 | 0.45 | −1.20 | ⊚ |
| 107 | 2.0 | 1.3 | 0 | B | Fifth Layer | 90.6 | 0.44 | −1.21 | ⊚ |
| 108 | 2.0 | 1.3 | 0 | B | Sixth Layer | 90.5 | 0.43 | −1.22 | ⊚ |
| 109 | 2.0 | 0.0 | 0 | B | Forth Layer | 92.2 | −1.20 | 0.90 | ○ |
| 110 | 3.0 | 0.0 | 0 | B | Forth Layer | 91.9 | −1.70 | −0.18 | Δ |
| 111 | 1.3 | 1.30 | 0 | B | Forth Layer | 91.1 | 0.83 | −0.80 | ⊚ |
| 112 | 2.6 | 0.65 | 0 | B | Forth Layer | 91.1 | −0.82 | −0.54 | ⊚ |
| 113 | 2.6 | 1.30 | 0 | B | Forth Layer | 90.2 | 0.02 | −1.81 | ○ |
| 114 | 2.6 | 1.95 | 0 | B | Forth Layer | 89.0 | 0.91 | −2.80 | Δ |
| 115 | 3.9 | 1.30 | 0 | B | Forth Layer | 88.2 | −0.43 | −2.74 | Δ |

It is understood from the results shown in Table 2 that the samples 103 to 115 according to the present invention, in which a blue pigment was co-emulsified at the time of preparation of the emulsified dispersion and the pigment was incorporated in the oil droplets dispersed in a hydrophilic colloid layer instead of a support, were easily tinted in the white background, even by a small amount of the pigment, so that an excellent white background could be attained, as compared to the sample 101 for comparison whose support contained a blue pigment. In addition, the results showed that employment of two or more kinds of the pigments in combination enables to arbitrarily control the hue, while maintaining excellent improvement in the white background. Further, the samples of the light-sensitive materials of the present invention were excellent in both light-resistance and heat-resistance of the white background portion, as well as stability during and after the processing. Further, the samples of the light-sensitive materials of the present invention did not cause any obstacle to form an image and consequently an excellent image could be obtained, as compared to conventional light-sensitive materials.

Example 2

The coating samples (101) to (115) prepared in Example 1 were subjected to laser scanning exposure, to form an image.

As the laser light source, 473 nm taken out by converting the wavelength of a YAG solid state laser (the emitting wavelength: 946 nm) using as an excitation light source a semiconductor laser GaAlAs (the emitting wavelength: 808.5 nm), by a SHG crystal of $LiNbO_3$ having an inversion domain structure; and 532 nm taken out by converting the wavelength of a $YVO_4$ solid state laser (the emitting wavelength: 1064 nm) using as an excitation light source a semiconductor laser GaAlAs (the emitting wavelength: 808.7 nm), by a SHG crystal of $LiNbO_3$ having an inversion domain structure; and AlGaInP (the emitting wavelength: 680 nm; Type No. LN9R20 manufactured by Matsushita Electric Industrial Co., Ltd.) were used. The scanning exposure was conducted in such a manner that each of three color laser beams could move in the direction vertical to the scanning direction by the reflection to a rotating polyhedrons, to successively scan the sample. The temperature of the semiconductor laser was kept, by using a Peltier device, to prevent the quantity of light from being fluctuated by temperature. An effective beam diameter was 80 $\mu$m. The scanning pitch was 42.3 $\mu$m (600 dpi) and the average exposure time per pixel was $1.7\times10^{-7}$ sec.

After exposure, the samples were processed and evaluated in the same manner as in Example 1. As a result, it was confirmed that the similar results as in Example 1 were obtained.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material, having, on a reflective support, at least one silver halide emulsion layer containing a cyan dye-forming coupler, at least one silver halide emulsion layer containing a magenta dye-forming coupler, at least one silver halide emulsion layer containing a yellow dye-forming coupler, and at least one light-insensitive layer, wherein oil droplets containing a dispersion of at least one blue pigment are dispersed in at least one layer of said layers.

2. The silver halide photographic light-sensitive material according to claim 1, wherein the at least one blue pigment is a pigment selected from a group consisting of indanthrone pigments, indigo pigments and triarylcarbonium pigments.

3. The silver halide photographic light-sensitive material according to claim 2, wherein the at least one blue pigment is an indanthrone pigment, and wherein at least one red pigment and/or at least one violet pigment, each of which is selected from a group consisting of azo pigments, quinacridone pigments, dioxazine pigments and diketopyrrolopyrrole pigments, is dispersed in at least one layer of the layers.

4. The silver halide photographic light-sensitive material according to claim 3, wherein the at least one blue pigment and the at least one red pigment and/or the at least one violet pigment are dispersed to incorporate in the same light-insensitive layer.

5. The silver halide photographic light-sensitive material according to claim 1, wherein a resultant hue of an unexposed portion after development processing, which is defined by L*, a* and b* stipulated in CIE LAB, satisfies the following relationship:

$L^*>88$, $-2<a^*<2$, and $-2<b^*<2$.

6. The silver halide photographic light-sensitive material according to claim 1, wherein the at least one blue pigment is contained in the at least one light-insensitive layer.

7. The silver halide photographic light-sensitive material according to claim 1, wherein a particle size after dispersion of the at least one blue pigment is in the range of 0.01 $\mu$m to 10 $\mu$m.

8. The silver halide photographic light-sensitive material according to claim 1, wherein the silver halide emulsion contains silver iodide.

9. The silver halide photographic light-sensitive material according to claim 1, wherein the silver halide emulsion is composed of silver halide grains having a silver bromide localized phase.

10. The silver halide photographic light-sensitive material according to claim 1, wherein the reflective support contains a white pigment.

11. The silver halide photographic light-sensitive material according to claim 1, wherein silver halide grains having a silver halide content of 95 mol % or greater, which are cubic or tetradecahedral crystal grains having {100} planes, are present in at least the following layers:

1) at least one silver halide emulsion layer containing a cyan dye-forming coupler;
2) at least one silver halide emulsion layer containing a magenta dye-forming coupler; and
3) at least one silver halide emulsion layer containing a yellow dye-forming coupler.

12. The silver halide photographic light-sensitive material according to claim 8, wherein iodide ions have a maximum concentration at the grain surface and the concentration decreases toward the inside of the grain.

* * * * *